US006125734A

United States Patent [19]

Yagla

[11] Patent Number: 6,125,734

[45] Date of Patent: Oct. 3, 2000

[54] MULTI-WARFARE AREA LAUNCHER

[75] Inventor: Jon J. Yagla, King George, Va.

[73] Assignee: The United States of America as represented by the Secretary of the Navy, Washington, D.C.

[21] Appl. No.: 09/170,651

[22] Filed: Oct. 14, 1998

[51] Int. Cl.[7] ..... F41F 3/04

[52] U.S. Cl. ..... 89/1.816; 89/1.8; 89/1.801; 89/1.815; 89/1.819

[58] Field of Search ..... 89/1.8, 1.816, 89/1.815, 1.817, 1.818, 1.819

[56] References Cited

U.S. PATENT DOCUMENTS

| | | | |
|---|---|---|---|
| 2,771,818 | 11/1956 | Lauritsen | 89/1.7 |
| 2,807,194 | 9/1957 | Cammin-Christy | 89/1.815 |
| 3,106,132 | 10/1963 | Biermann et al. | 89/1.815 |
| 3,316,808 | 5/1967 | Mais | 89/1.804 |
| 3,357,305 | 12/1967 | Clutz et al. | 89/1.815 |
| 3,406,606 | 10/1968 | Schoffl | 89/1.815 |
| 3,769,876 | 11/1973 | Haas et al. | 89/1.8 |
| 3,865,009 | 2/1975 | Kongelbeck | 89/1.815 |
| 4,470,336 | 9/1984 | Swann et al. | 89/1.815 |
| 4,604,939 | 8/1986 | Hoffmiester et al. | 89/1.816 |
| 5,327,809 | 7/1994 | Matteson et al. | 89/1.817 |

*Primary Examiner*—Charles T. Jordan
*Assistant Examiner*—Michelle Thomson
*Attorney, Agent, or Firm*—James B. Bechtel, Esq.; John P. McMahon, Esq.

[57] ABSTRACT

A modular horizontal launching system is disclosed comprised of modules having scalable dimensions so as to easily accommodate the handling of different launchable devices. The launching system has a canister that not only serves as a launch tube but also has a shipping container for the launchable devices.

7 Claims, 5 Drawing Sheets

FIG.2
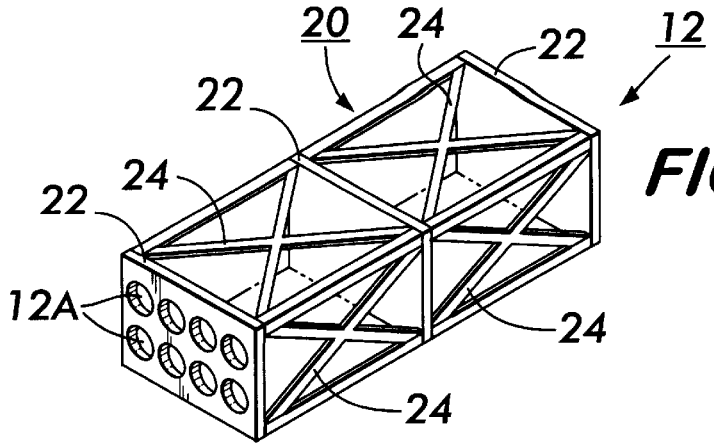
FIG.2A
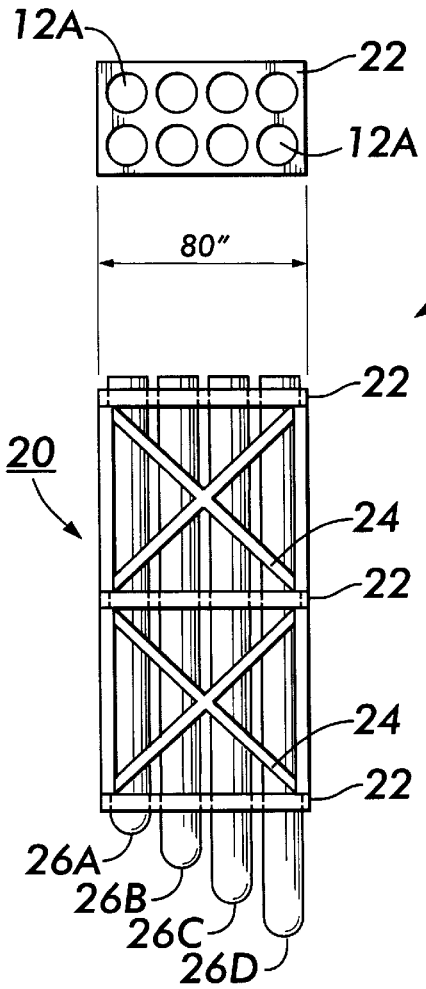
FIG.2B
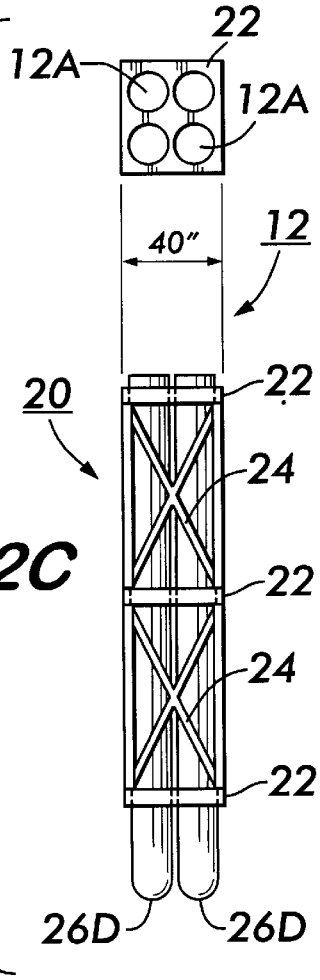
FIG.2C

FIG. 3
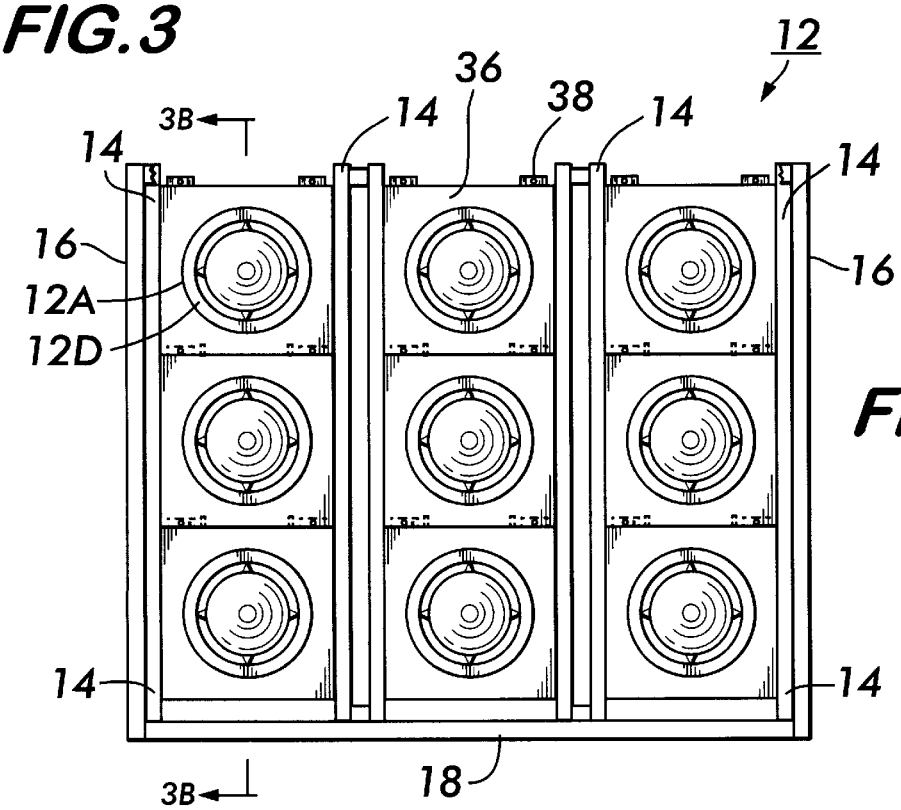
FIG. 3A
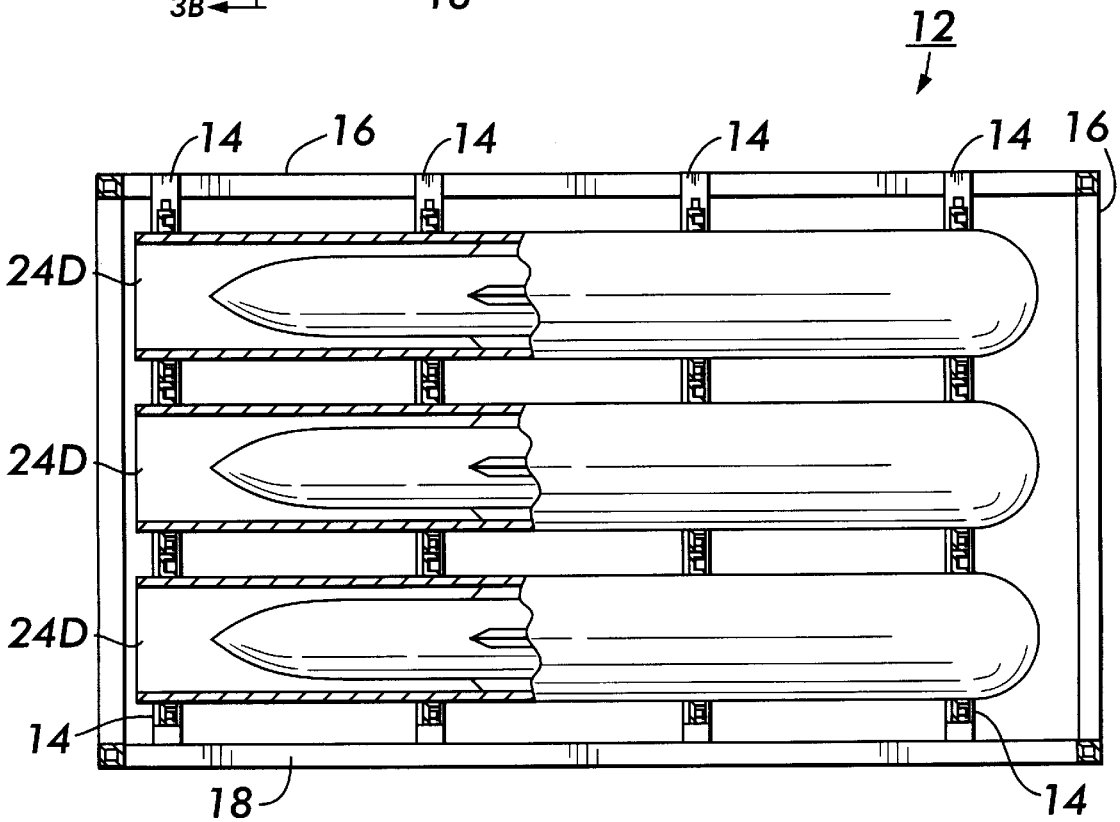
FIG. 3B

MULTI-WARFARE AREA LAUNCHER

STATEMENT OF GOVERNMENT INTEREST

The invention described herein may be manufactured and used by or for the Government of the United States of America for governmental purposes without any payment of any royalties thereon or therefor.

BACKGROUND OF THE INVENTION 1.0 Field of the Invention

The present invention relates to a launching system for launching torpedoes, sensors, countermeasures, decoys, and unmanned aerial vehicles and, more particularly, to a launching system having modular canisters that serve as launch tubes that accommodate launchable devices having different scalable dimensions, while also serving as shipping containers therefor.

2.0 Description of the Related Art

A ship or a vessel assigned to a tactical mission commonly carries multiple launching systems that are custom made to satisfy individual specifications of individual launchable devices such as torpedoes, sensors, countermeasures, decoys and unmanned aerial vehicles. In addition to occupying valuable on-board space, these multiple launching systems need to be updated to track the changes and improvements to the launchable devices so as to provide successful launchers thereof. Launching systems are well known and some of which are disclosed in U.S. Pat. Nos. 2,771,818; 3,106,132; 3,357,305; 3,769,876; 4,604,939; and 5,327,809, all of which are herein incorporated by reference. It is desired that a single launching system be provided having scalable dimensions and adaptability so as to easily integrate and satisfy the requirements of the various present and future launchable devices each with individual specifications.

Launchable devices are commonly transported using shipping canisters for loading on-board to the vessel or ship. Once on-board, the launchable devices need to be removed from their shipping canisters and stored or placed directly into their associated launcher. Over and above, the unwanted time and effort expended for transferring the launchable devices from their shipping containers to their associated launcher, such time delays the desired employment of the ship or vessel to its assigned mission. It is desired to provide for canisters that serve as both shipping containers and launchable tubes.

OBJECTS OF THE INVENTION

It is a primary object of the present invention to provide a launching system having canisters that serve as both shipping containers and launch tubes.

Another object of the present invention is to provide a single launching system having scalable dimensions and adaptability so as to easily integrate and satisfy the requirements of launchable devices having different dimensions.

It is another object of the present invention to provide a launching system that handles a mix of launchable devices yet accommodates the requirements of each different launchable device.

SUMMARY OF THE INVENTION

The invention is directed to a launching system having scalable dimensions and adaptability to accommodate a mix of different launchable devices having different dimensions.

The launching system comprises a plurality of canisters each serving as both shipping containers and launch tubes and with at least two of the plurality of canisters holding launchable devices having different but scalable dimensions. The launching system further comprises a plurality of partitions spaced apart from each other so that the plurality of canisters are arranged into tiers with at least two columns of the tiers having stacked canisters of the two different launchable devices.

BRIEF DESCRIPTION OF THE DRAWINGS

A better understanding of the present invention may be realized when considered in view of the following detailed description, taken in conjunction with the accompanying drawings.

FIG. 2 is composed of FIGS. 2(A), 2(B) and 2(C) and cumulatively and generally illustrates various features of the canister of the present invention.

FIG. 3 is composed of FIGS. 3(A) and 3(B) that illustrate one configuration of the canisters in one tier of the launching system of the present invention.

DETAILED DESCRIPTION OF THE PREFERRED EMBODIMENTS

Figure 1:
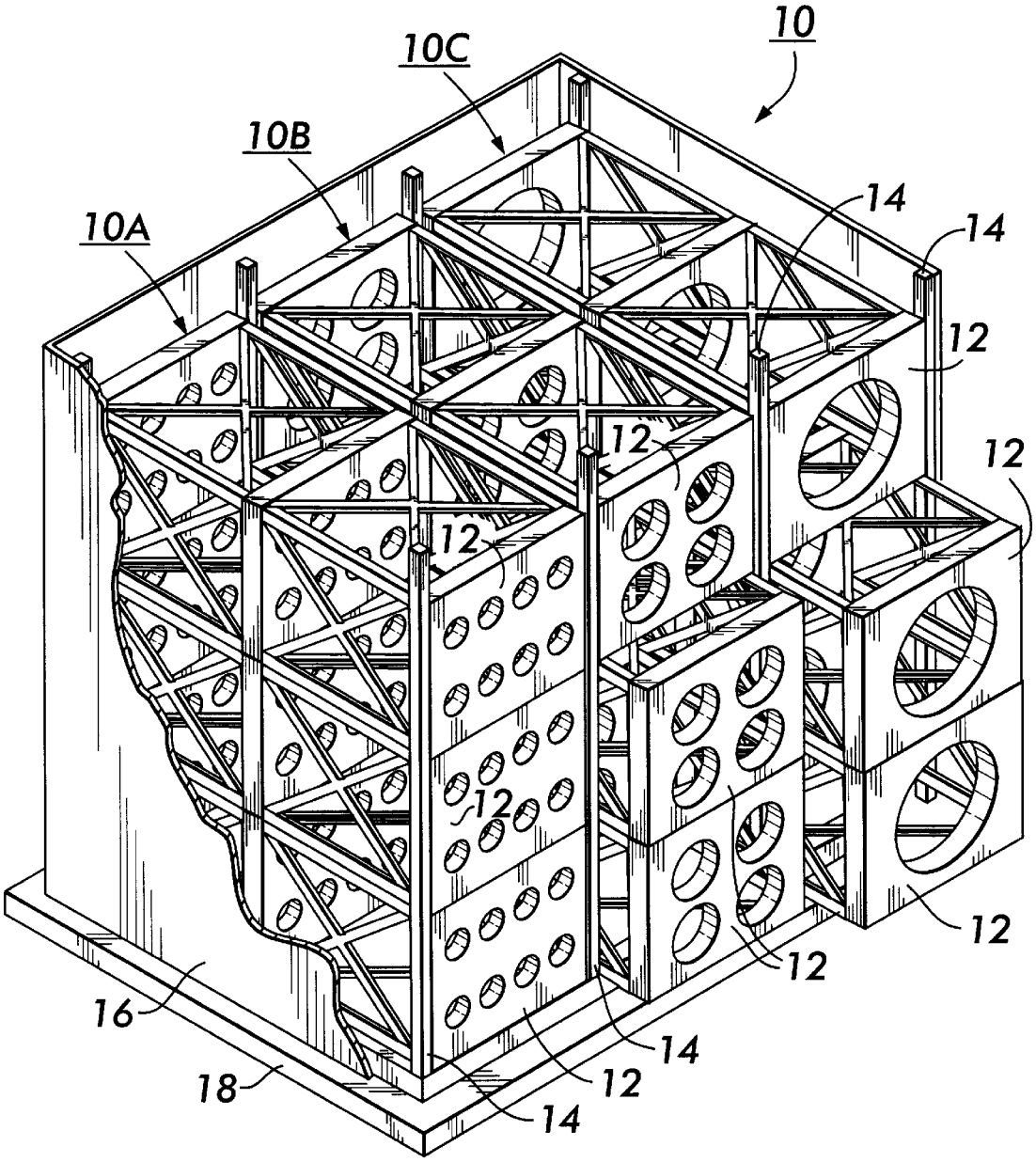
FIG. 1 is an isometric view of the launching system of the present invention.

Referring to the drawings, wherein the same reference number indicates the same element throughout, there is shown in FIG. 1 a isometric view of the launcher system 10 for one embodiment of the present invention.

The launching system 10 comprises a plurality of canisters 12 each serving as both a shipping container and as a launch tube and with at least two of the plurality of canisters 12 holding launchable devices having different, but scalable dimensions. As used herein, scalable dimensions is meant to represent that the dimensions of one launchable device may be translated to another, but different, launchable device by using a simple proportion.

The launching system 10 further comprises a plurality of partitions 14 having upper and lower portions and spaced apart from each other so that the plurality of canisters 12 are arranged into tiers having columns, for example, 10A, 10B and 10C, with at least two columns, such as 10A and 10B, of the tiers having stacked canisters 12 of the two different launchable devices.

The launching system 10 further comprises a housing 16 having side walls and a base to which the lower end of each partition 14 is affixed. The launching system 10 also has a platform 18 on which the base of the housing 16 is attached. The housing 16 partially encloses all sides of the canisters 12, except for the front section thereof. The canisters 12 may be further described with reference to FIG. 2.

FIG. 2 is composed of FIGS. 2(A), 2(B) and 2(C), wherein FIG. 2(A) is a schematic illustrating the frame member 20 of the canister 12. The frame member 20 has front, intermediate, and rear sections all indicated with the reference numbers 22, but with only the front section 22 being shown. Each of the front, intermediate and rear sections 22 has openings 12A which have dimensions that are somewhat greater than the corresponding outer diameter of the launchable devices (to be described with reference to FIGS. 2(B) and 2(C)) being carried by the respective canister 12.

The frame member 20 also has interconnecting sections 24 for joining together the front, intermediate and rear sections 22. The interconnecting sections 24 comprise criss-crossed supports having opposite ends merged with and joined to the front, intermediate and rear sections 22, as shown in FIG. 2(A).

FIG. 2(B) illustrates the front section 22 as having the openings 12A and a typical length dimension of eighty (80) inches. FIG. 2(B) illustrates the frame member 20 as enclosing four (4) different types of launchable devices, such as four (4) different cylindrical torpedoes 26A, 26B, 26C and 26D. From FIG. 2(B) it is seen that the frame member 20 only needs to be selected so that the front intermediate and rear portions 22 provide support for the smallest length launchable device 26A, but allowing for the front intermediate, and rear sections 22 to also provide for support for the three (3) other launchable devices 26B, 26C and 26D, which extend past the front section 22. From FIG. 2(B) it is seen that the canister 12 accommodates a multitude of dissimilar launchable devices having different dimensions. The ability of the canister 12 to accommodate other launchable devices may be further described with reference to FIG. 2(C).

FIG. 2(C) illustrates that the canister 12 can easily accommodate two (2) launchable devices 26D. From a review of FIGS. 2(B) and 2(C), it can be seen that the canister 12 by having scalable dimensions such as scaling the length of the front intermediate and rear portions 22 from 80 inches (FIG. 2(B)) to 40 inches (FIG. 2(C)), the canister 12 easily accommodates two rather than four launchable devices. The flexibility of the present invention may be further described with reference to FIG. 3 which is composed of FIGS. 3(A) and 3(B).

FIG. 3(A) illustrates a canister 12 comprised of a single tier having three rows and three columns, with each row and column having an opening 12A, which, as generally shown in FIG. 3A, exposes one end of a launchable device, such as 24D. The launchable device 24D is further shown in FIG. 3(B), which is a view taken along line 3B—3B of FIG. 3(A).

FIG. 3(B) illustrates the launchable devices 24D as having a horizontal orientation within the canister 12. FIG. 3(B) also illustrates the canister 12 as being joined to the partitions 14. The lower end of the partitions 14 are all connected to the platform 18, whereas some of the upper portions of partitions 14 are connected to the enclosure 16 which is also shown in FIG. 3(A).

The front section of the canister 12 is comprised of segments 36, with each segment 36 carrying one opening 12A and with each segment having means, comprised of stud member 38, for being releasably connected to each other segment, and which may be further described with reference to FIG. 4.

The releasably connected segment 36 comprises at least two oppositely disposed upwardly protruding stud members 38 having predetermined dimensions and an aperture therein. The means for being releasably connected further comprises an opening 40 located adjacent to each of the stud members 38, as well as a channel 42 and a pin 44 that respectively mate with stud member 38 and opening 40.

Figure 4:
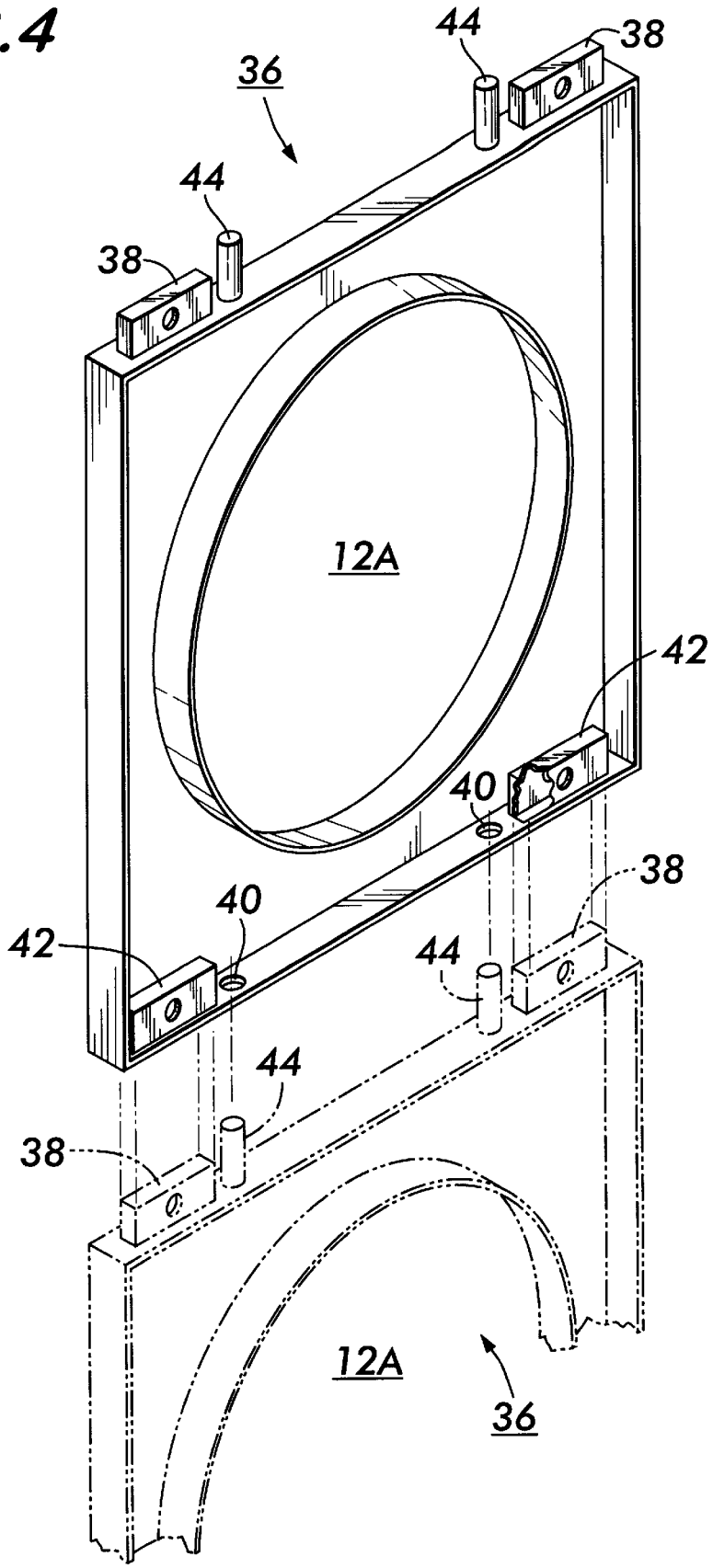
FIG. 4 illustrates one segment of the front section of the canister of FIG. 3(A).
Figure 5:
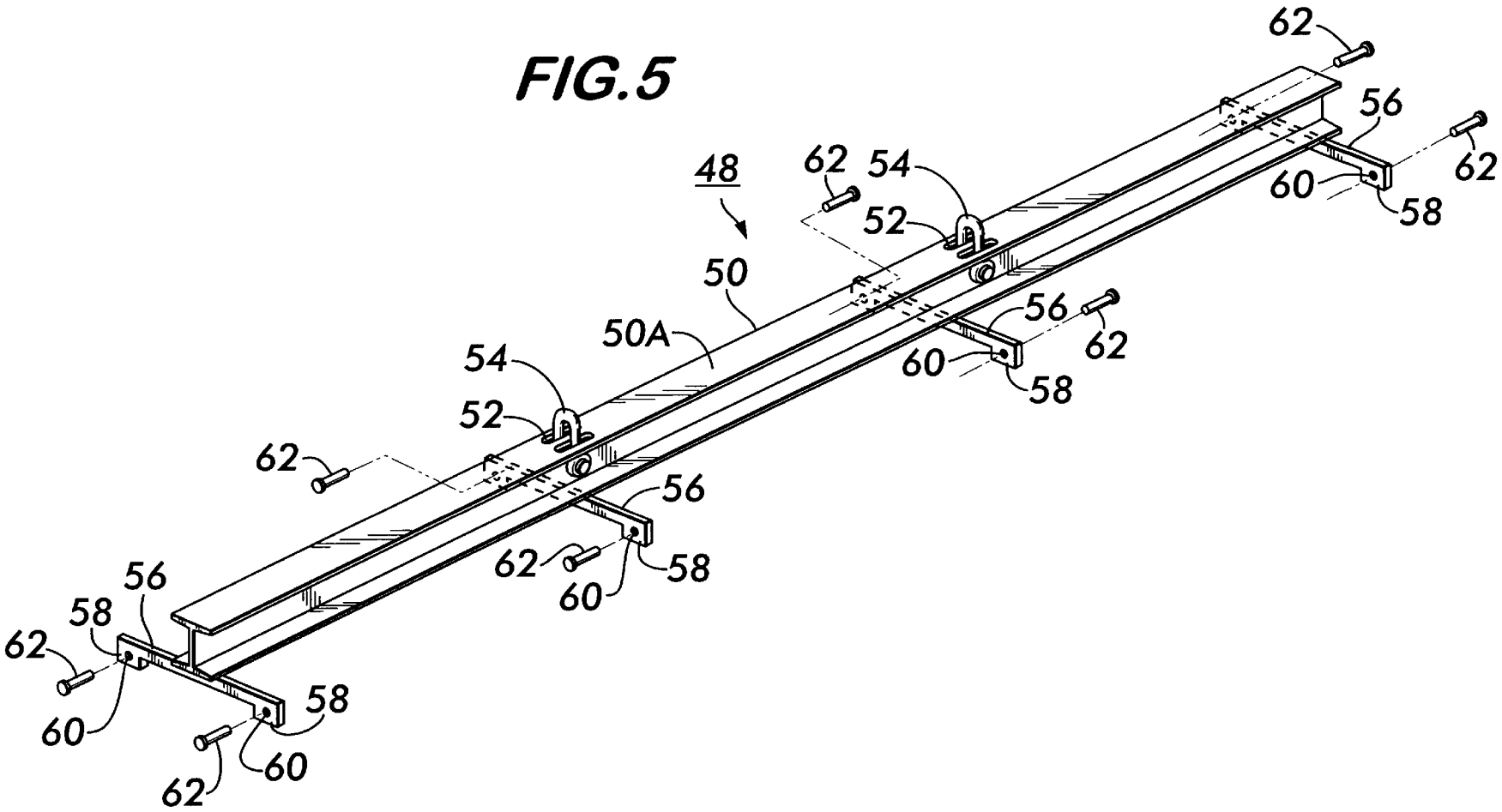
FIG. 5 illustrates a shipping device for the movement of the canisters of FIGS. 2 and 3.

As seen in FIG. 4, one segment 36, lower segment 36 shown in phantom, is mated to another segment 36A, upper segment 36 shown in solid in FIG. 4, by having the stud member 38 of the lower segment 36 inserted into the channel 42 of the upper segment 36 and then allowing the pin 44 of the upper segment 36 to be positioned into the opening 40 of the lower segment 36. The canister 12 may be easily moved by a shipping device 48 which may be further described with reference to FIG. 5.

The lifting device 48 comprises an I-beam 50 having elongated top section 50A with elongated openings 52 therein and into which is inserted at least one eye hook 54. The lifting device 48 further comprises at least two capturing members 56, but preferably four, each of which have channels 58 that are dimensioned so as to allow for the insertion of the stud members 38 therein. The capturing members 56 each has a passageway 60 that lines up with the aperture in the stud members 38. When the stud members 38 are inserted into the channel 58 of the capturing members 56, a pin 62 is inserted into the passageway 60 so as to releasably connect the stud member 38 to the respective capturing member 56.

The joined condition allows for a crane mechanism having appropriate hook connections to be inserted in two eye hooks 54 to allow the lifting of the I-beam 50 which, in turn, lifts the capturing members 56 which, in turn, lifts the stud members 38 which, in turn, lifts the canister 12 which, in turn, allows the crane operator to move the canister 12 to its desired location.

It should now be appreciated that the practice of the present invention provides for a shipping device 48 that allows for the easy movement of the canister 12.

It should be further appreciated that the practice of the present invention provides a single launching system 10 that easily accommodates multiple launchable devices including a mix thereof. Further, the present invention provides for the canister 12 that not only serves as a launch tube but also serves as a shipping container.

While the invention has been described with reference to the specific embodiments, this description is illustrated and is not to be construed as limited in the scope of the invention. Various modifications will occur to those skilled in the art without departing from the spirit and scope of the invention as defined by the appended claims.

What I claim is:

1. A launching system comprising:

(a) a plurality of tubeless canisters each serving as both shipping containers and launch tubes and with at least two of said plurality of canisters holding launchable devices having different but scalable dimensions; and (b) a plurality of partitions spaced apart from each other so that said plurality of canisters are arranged into tiers with at least two columns of said tiers having stacked canisters of said two different launchable devices.

2. The launching system according to claim 1, wherein said partitions have lower and upper ends and further comprising:

(a) a housing having side walls and a base to which said lower end of each partition is affixed; and (b) a platform on which said base of said housing is attached.

3. A launching system comprising:

(a) a plurality of canisters each serving as both shipping containers and launch tubes and with at least two of said plurality of canisters holding launchable devices having different but scalable dimensions, each of said launchable devices being cylindrical and having a known outer diameter and each of said plurality of canisters comprising:

(i) front, intermediate, and rear sections, each section having openings extending therethrough with dimensions which are somewhat greater than said outer diameter of said launchable devices; and (ii) interconnecting sections for joining said front, intermediate and rear sections;

(b) a plurality of partitions spaced apart from each other so that said plurality of canisters are arranged into tiers with at least two columns of said tiers having stacked canisters of said two different launchable devices, (c) a housing having side walls and a base to which said lower end of each partition is affixed and a platform on which said base of said housing is attached.

4. The launching system according to claim 3, wherein said interconnecting sections comprise criss-crossed supports having opposite ends merged with said front, intermediate and rear sections.

5. The launching system according to claim 3, wherein said front sections are comprised of segments with each segment carrying one opening and with each segment having means for being releasably connected to each other segment.

6. The launching system according to claim 5, wherein said means for being releasably connected comprises at least two oppositely disposed upwardly protruding stud members having predetermined dimensions and an aperture therein.

7. The launching system according to claim 6 further comprising a lifting device comprising:

(a) an I-beam having elongated openings in its top section into which is inserted and connected at least one eye hook;

(b) at least two capturing members having channels that are dimensioned so as to allow the insertion of said stud members and having passageways that line-up with said aperture in said stud members; and (c) pins dimensioned to be inserted into said passageways and said apertures of said stud members.

* * * * *